US009028046B2

(12) United States Patent
Saiga et al.

(10) Patent No.: US 9,028,046 B2
(45) Date of Patent: May 12, 2015

(54) IMAGE FORMING APPARATUS

(71) Applicants: Soichi Saiga, Tokyo (JP); Shinichiroh Naruse, Kanagawa (JP); Kenji Shimizu, Kanagawa (JP)

(72) Inventors: Soichi Saiga, Tokyo (JP); Shinichiroh Naruse, Kanagawa (JP); Kenji Shimizu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/016,419

(22) Filed: Sep. 3, 2013

(65) Prior Publication Data

US 2014/0063123 A1 Mar. 6, 2014

(30) Foreign Application Priority Data

Sep. 5, 2012 (JP) ..... 2012-194927

(51) Int. Cl.

| | |
|---|---|
| ***B41J 25/308*** | (2006.01) |
| ***B41J 2/015*** | (2006.01) |
| ***B41J 23/00*** | (2006.01) |
| ***B41J 2/145*** | (2006.01) |
| ***B41J 2/175*** | (2006.01) |
| ***B41J 25/34*** | (2006.01) |

(52) U.S. Cl.

CPC ..... *B41J 2/145* (2013.01); *B41J 2/1752* (2013.01); *B41J 25/34* (2013.01); *B41J 2202/14* (2013.01); *B41J 2/17553* (2013.01)

(58) Field of Classification Search

CPC ..... B41J 2/145
USPC ..... 347/8, 20, 37
See application file for complete search history.

(56) References Cited

U.S. PATENT DOCUMENTS

| | | | | |
|---|---|---|---|---|
| 2006/0146106 | A1 | 7/2006 | Naruse | |
| 2006/0268053 | A1 | 11/2006 | Naruse | |
| 2007/0126787 | A1 | 6/2007 | Naruse | |
| 2010/0231643 | A1 | 9/2010 | Saiga et al. | |
| 2010/0295897 | A1 | 11/2010 | Naruse et al. | |
| 2011/0134187 | A1 | 6/2011 | Naruse et al. | |
| 2011/0134190 | A1 | 6/2011 | Mase et al. | |
| 2011/0141192 | A1 | 6/2011 | Komuro et al. | |
| 2011/0199410 | A1 | 8/2011 | Mase et al. | |
| 2011/0205299 | A1 | 8/2011 | Naruse et al. | |
| 2011/0216113 | A1 | 9/2011 | Yorimoto et al. | |
| 2012/0105532 | A1 * | 5/2012 | Sanada | 347/16 |
| 2012/0306960 | A1 | 12/2012 | Niihara et al. | |
| 2012/0306967 | A1 | 12/2012 | Shimizu et al. | |
| 2012/0306970 | A1 | 12/2012 | Naruse et al. | |
| 2013/0070022 | A1 | 3/2013 | Ogawa et al. | |

FOREIGN PATENT DOCUMENTS

| | | |
|---|---|---|
| JP | 2005-224685 | 8/2005 |
| JP | 2007-276289 | 10/2007 |

* cited by examiner

*Primary Examiner* — Jason Uhlenhake
(74) *Attorney, Agent, or Firm* — Cooper & Dunham LLP

(57) ABSTRACT

An image forming apparatus includes a plurality of recording heads, a plurality of head holders to hold the recording heads, a guide member extending in a main scanning direction, a carriage movable in the main scanning direction along the guide member to hold the head holders, a reference member provided to the carriage and extending in the same direction as the guide member extends, an intermediate holder disposed between the carriage and the head holders and supported by the carriage with the reference member and at least two sub-reference portions, an adjustment member provided to at least one of the two sub-reference portions to displace the one of the two sub-reference portions relative to the carriage, and a contact portion provided to each of the head holders to contact against the intermediate holder in a direction perpendicular to the direction in which the reference member extends.

8 Claims, 11 Drawing Sheets

IMAGE FORMING APPARATUS

CROSS-REFERENCE TO RELATED APPLICATION

This patent application is based on and claims priority pursuant to 35 U.S.C. §119 to Japanese Patent Application No. 2012-194927, filed on Sep. 5, 2012, in the Japan Patent Office, the entire disclosure of which is hereby incorporated by reference herein.

BACKGROUND

1. Technical Field

Exemplary aspects of the present invention generally relate to an image forming apparatus employing a liquid ejection recording method.

2. Related Art

Like a printer, copier, plotter, facsimile machine, or multi-function device having two or more of these capabilities, an inkjet recording device employing a liquid ejection recording method is also a type of image forming apparatus. Typically, the inkjet recording device includes a recording head constructed of a liquid ejection head that ejects droplets of a recording liquid such as ink onto a sheet of a recording medium to form an image on the sheet.

The quality of images formed by the inkjet-type image forming apparatus varies considerably depending on accuracy in landing positions of droplets ejected from nozzles formed in a nozzle face of the recording head. Therefore, it is necessary to accurately position the recording head within the image forming apparatus to improve the accuracy in the landing positions of the droplets, thereby providing higher-quality images.

There is known an image forming apparatus in which multiple recording heads are mounted on a carriage. A mounting position of each of the recording heads on the carriage is adjusted to align the landing positions of the droplets in a sub-scanning direction (or a direction of conveyance of the sheet).

JP-2005-224685-A discloses an image forming apparatus including a main carriage and a sub-carriage. The sub-carriage mounts multiple recording heads thereon and is positioned relative to the main carriage. Relative positions of the main carriage and the sub-carriage are adjustable upon installation of the carriages in the image forming apparatus.

There is increasing demand for easy adjustment of the landing positions of the droplets in the sub-scanning direction after the recording heads are installed in the image forming apparatus and the landing positions of the droplets in the sub-scanning direction are confirmed. However, the above-described image forming apparatuses do not meet such demand.

SUMMARY

In view of the foregoing, illustrative embodiments of the present invention provide a novel image forming apparatus that facilitates adjustment of landing positions of droplets in a sub-scanning direction in a state in which recording heads are installed in the image forming apparatus.

In one illustrative embodiment, an image forming apparatus includes: a plurality of recording heads, from each of which droplets are ejectable; a plurality of head holders to hold the plurality of recording heads; a guide member extending in a main scanning direction; a carriage movable in the main scanning direction along the guide member to hold the plurality of head holders; a reference member provided to the carriage and extending in the same direction as the guide member extends, the reference member holding the plurality of head holders arranged side by side; an intermediate holder disposed between the carriage and the plurality of head holders and supported by the carriage with the reference member as a main reference portion and at least two sub-reference portions provided thereto; an adjustment member provided to at least one of the two sub-reference portions to displace the one of the two sub-reference portions relative to the carriage; and a contact portion provided to each of the plurality of head holders. The plurality of head holders are movable, with the reference member as a main reference portion, to contact the contact portion against the intermediate holder in a direction perpendicular to the direction in which the reference member extends.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
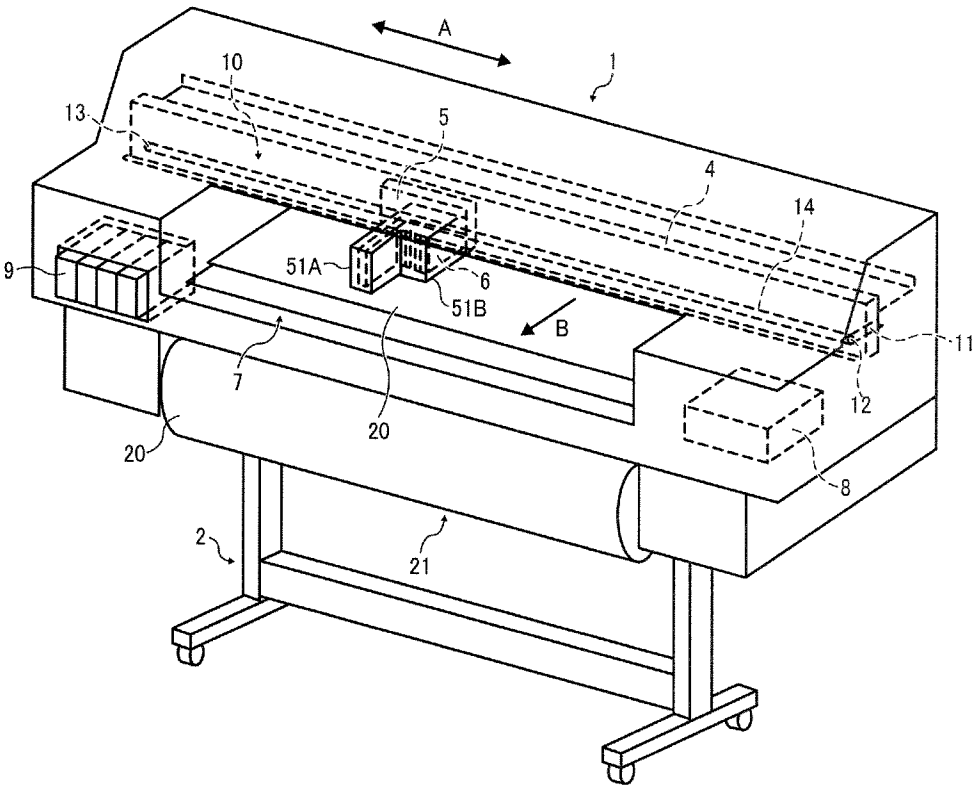
FIG. 1 is a perspective view illustrating the external appearance of an example of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have substantially the same function, operate in a similar manner, and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

It is to be noted that a "sheet" of recording media is not limited to a sheet of paper but also includes any material onto which droplets including ink droplets adhere, such as an OHP sheet, cloth, glass, and a substrate.

Image forming apparatuses hereinafter described form an image on a recording medium, such as paper, string, fiber, cloth, lather, metal, plastics, glass, wood, and ceramics by ejecting droplets onto the recording medium. In this specification, an image refers to both signifying images such as characters and figures, as well as a non-signifying image such as patterns.

In addition, ink includes any material which is a liquid when ejected from the image forming apparatuses to form images on the recording medium, such as a DNA sample, a resist material, a pattern material, and resin.

Further, an image formed on the recording medium is not limited to a flat image, but also includes an image formed on a three-dimensional object, a three-dimensional image, and so forth.

It is to be noted that image forming apparatuses hereinafter described include not only serial-type image forming apparatuses but also line-type image forming apparatuses.

Figure 2:
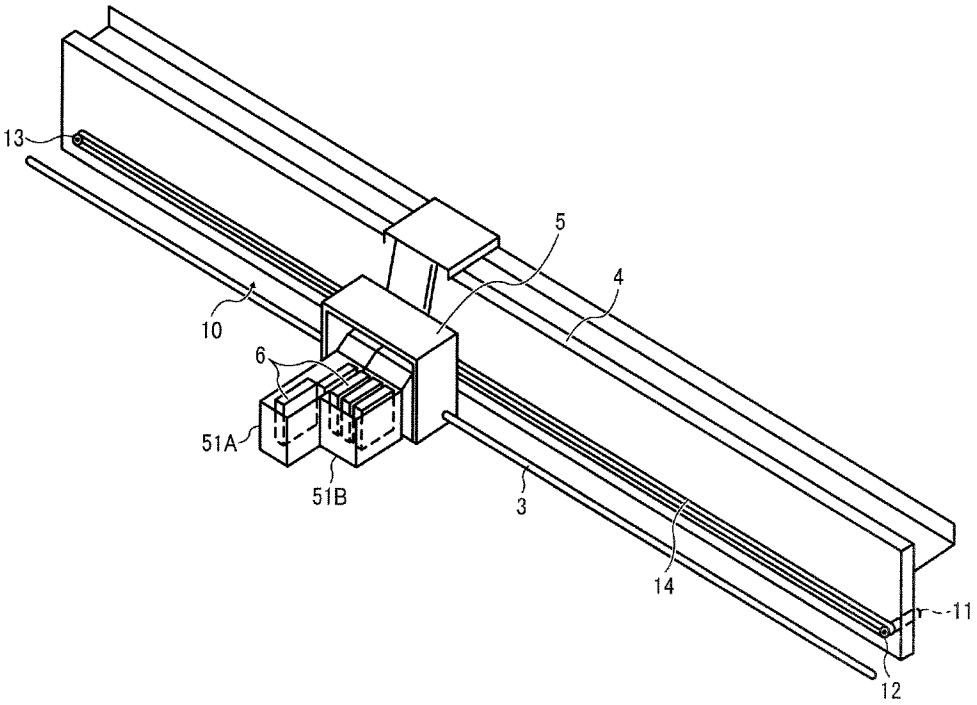
FIG. 2 is a perspective view illustrating an example of a configuration of a main scanning mechanism included in the image forming apparatus.

A description is now given of a configuration and operation of an image forming apparatus 1 according to illustrative embodiments, with reference to FIGS. 1 and 2.

FIG. 1 is a perspective view illustrating the external appearance of an example of the image forming apparatus 1 according to illustrative embodiments. FIG. 2 is a perspective view illustrating an example of a configuration of a main scanning mechanism 10 included in the image forming apparatus 1.

The image forming apparatus 1 is a serial-type inkjet recording device and is constructed of the body and a support stand 2 that supports the body. In the body of the image forming apparatus 1, a carriage 5 is slidably held by a guide member, which, in the present illustrative embodiment, is a guide rod 3, and a guide stay 4, each extended between lateral plates of the image forming apparatus 1, so that the carriage 5 is reciprocally movable back and forth in a main scanning direction indicated by double-headed arrow A in FIG. 1.

Recording heads 6A, 6B, 6C, 6D, and 6E (shown in FIGS. 3, 4, and 6 and hereinafter collectively referred to as recording heads 6), each constituted of a liquid ejection head having multiples nozzles from which ink droplets of a specific color, that is, black (K), yellow (Y), magenta (M), or cyan (C), are ejectable, are installed in the carriage 5. A head tank that supplies ink to each of the recording heads 6 is formed together with the corresponding recording head 6 as a single integrated unit.

A main scanning mechanism 10 that drives the carriage 5 includes a drive motor 11 provided at one end in the main scanning direction, a drive pulley 12 rotatively driven by the drive motor 11, a driven pulley 13 provided at the other end in the main scanning direction, and a timing belt 14 wound around the drive pulley 12 and the driven pulley 13. A tension spring, not shown, applies tension to the driven pulley 13 outward, that is, in a direction away from the drive pulley 12.

The carriage 5 has a main scanning range through which it scans in the main scanning direction, and within this range is a recording range. A sheet 20 is intermittently conveyed to the recording range by a conveyance part 7 in a sheet conveyance direction indicated by arrow B in FIG. 1. It is to be noted that the sheet conveyance direction is perpendicular to the main scanning direction of the carriage 5 and is identical to a sub-scanning direction.

A maintenance/recovery mechanism 8 that performs maintenance and recovery of the recording heads 6 is provided at one end of the main scanning range in the main scanning direction. Cartridges 9 that respectively store ink of the specified colors to be supplied to the respective sub-tanks included in the recording heads 6 are detachably attached to the body of the image forming apparatus 1 at a portion outside the main scanning range of the carriage 5 in the main scanning direction or at the other end of the main scanning range.

A sheet roll 20 (hereinafter also referred to as the sheet 20) is set in a sheet feeder 21. The sheet feeder 21 can accommodate a sheet roll of various sizes in a sheet width direction. The sheet 20 fed from the sheet feeder 21 is conveyed through a sheet conveyance path from the back to the front of the image forming apparatus 1 to the recording range by a conveyance unit, not shown. The sheet 20 is then intermittently conveyed by the conveyance part 7. The recording heads 6 are driven based on image data while the carriage 5 is moved in the main scanning direction so that droplets are ejected from the recording heads 6 onto the sheet 20, which remains stationary, so as to form a single line of an image to be formed on the sheet 20. Thereafter, the conveyance part 7 conveys the sheet 20 by a predetermined amount to perform image formation of the next line. The above-described processes are repeated to form the image on the sheet 20. The sheet 20 having the image formed thereon is then cut to a predetermined length and is discharged to a discharge tray, not shown, provided on the front side of the image forming apparatus 1.

Figure 3:
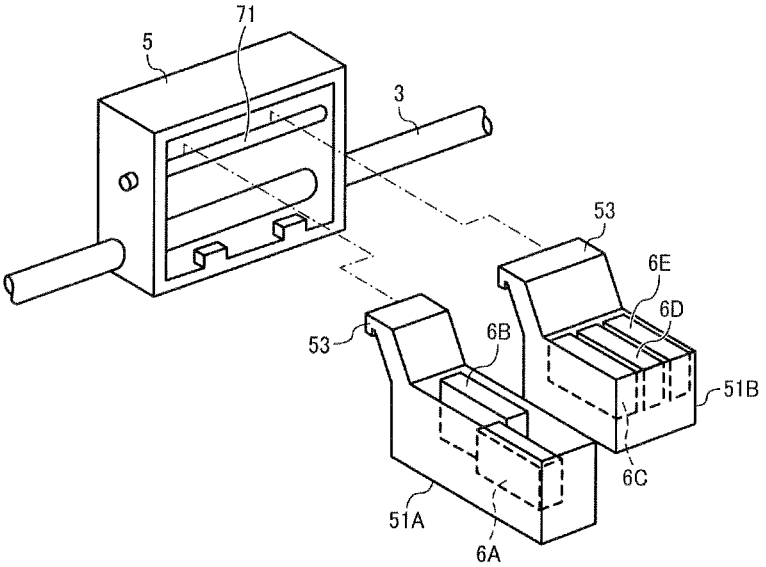
FIG. 3 is a perspective view illustrating an example of a configuration of a carriage included in an image forming apparatus according to a first illustrative embodiment in a state in which head holders are not mounted thereon.
Figure 4:
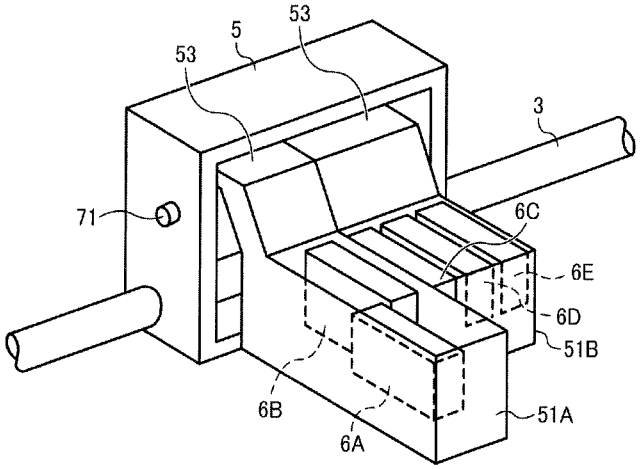
FIG. 4 is a perspective view of the carriage on which the head holders are mounted.

A description is now given of a configuration and operation of the carriage 5 included in the image forming apparatus 1 according to a first illustrative embodiment, with reference to FIGS. 3 and 4.

FIG. 3 is a perspective view of the carriage 5, on which first and second head holders 51A and 51B are not mounted. FIG. 4 is a perspective view of the carriage 5 with the first and second head holders 51A and 51B mounted thereon.

The first head holder 51A for the color of black (K) and the second head holder 51B for the colors of yellow (Y), magenta (M), and cyan (C) are held by the carriage 5. The recording heads 6A and 6B, each ejecting black ink droplets, are mounted on the first head holder 51A at different positions in the sub-scanning direction. The recording heads 6C, 6D, and 6E, each ejecting ink droplets of yellow (Y), magenta (M), or cyan (C), are mounted on the second head holder 51B at the same position as the recording head 6B of the first head holder 51A in the sub-scanning direction, respectively. It is to be noted that, the recording heads 6A, 6B, 6C, 6D, and 6E are hereinafter collectively referred to as the recording heads 6, unless otherwise distinguished from one another. Although holding the multiple recording heads 6 in the above-described example, alternatively, each of the first and second head holders 51A and 51B may hold a single recording head 6, respectively.

A reference member, which, in the present illustrative embodiment, is a reference shaft 71 that extends in the same directions as the guide rod 3 extends, that is, the main scanning direction, is provided to the carriage 5. Each of the first and second head holders 51A and 51B (hereinafter collectively referred to as head holders 51) has a hook 53 detachably engageable with the reference shaft 71. The hooks 53 of the head holders 51 are hooked on the reference shaft 71 so that the head holders 51 are held by the carriage 5. It is to be noted that, the reference shaft 71 may be shaped either in a cylinder or a polygonal prism. Because the reference shaft 71 extends in the same directions as the guide member 3 extends, the head holders 51 are accurately positioned within the carriage 5 in the sub-scanning direction, a height direction, a tilting direction, and the main scanning direction.

Upon replacement of the recording heads 6 with new recording heads 6, the first or second head holder 51A or 51B is detached from the reference shaft 71. After the new recording heads 6 are installed in the first or second head holder 51A or 51B, the hook 53 of the first or second head holder 51A or 51B is hooked on the reference shaft 71 so that the first or second head holder 51A or 51B is held by the carriage 5. Accordingly, after the replacement of the recording heads 6, the head holders 51 are accurately positioned within the carriage 5 and the relative positions of the head holders 51 are accurately set.

Thus, the above-described configuration of the image forming apparatus 1 allows easy positioning of the recording heads 6 mounted on the head holders 51 relative to one another and easy replacement of the recording heads 6.

Figure 5:
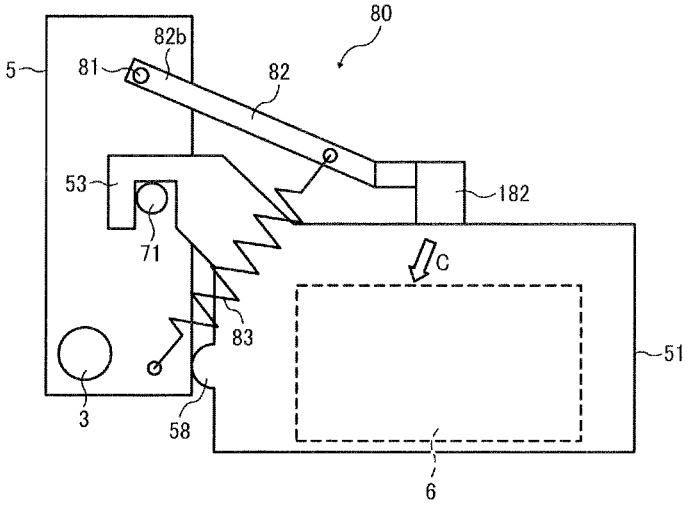
FIG. 5 is a side view illustrating an example of a configuration of a pressing mechanism included in the image forming apparatus.
Figure 6:
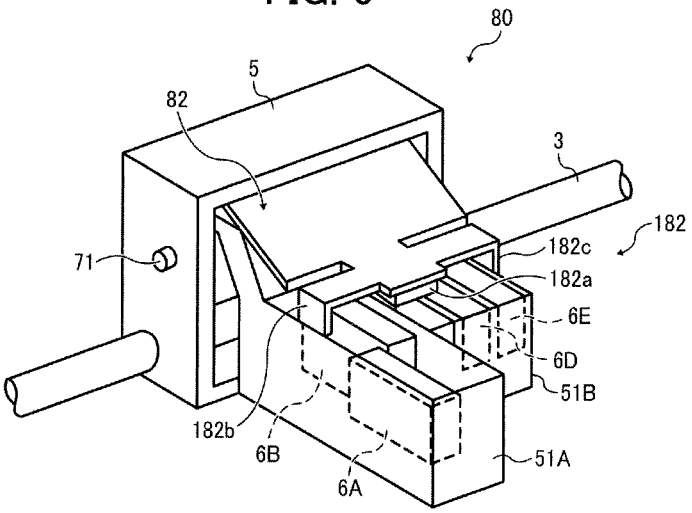
FIG. 6 is a perspective view of the pressing mechanism to which a cover member is provided.

A description is now given of a configuration of a pressing mechanism 80 included in the image forming apparatus 1, with reference to FIGS. 5 and 6.

FIG. 5 is a side view illustrating an example of a configuration of the pressing mechanism 80. FIG. 6 is a perspective view of the pressing mechanism 80 to which a cover member 82 provided.

Each of the head holders 51 has a contact portion 58 at least at one position thereof. The contact portion 58 of each of the head holders 51 is pressed toward the carriage 5 to contact against an intermediate holder 31, which is not shown in FIG. 5 for ease of illustration and is described in detail later with reference to FIG. 7 and subsequent drawings. It is to be noted that, although the single hook 53 is provided to each head holder 51 in the main scanning direction in the example described above, alternatively, two hooks 53 may be respectively provided at both ends of each head holder 51 in the main scanning direction, or multiple hooks 53 may be provided to each head holder 51 in the main scanning direction.

The image forming apparatus 1 further includes the pressing mechanism 80 that presses the head holders 51 toward the carriage 5 with the reference shaft 71 as a pivot. The pressing mechanism 80 includes a pressing member, which in the present illustrative embodiment, is the cover member 82. A trailing edge 82*b* of the cover member 82 is rotatably supported by the carriage 5 about a shaft 81. As illustrated in FIG. 6, the cover member 82 is substantially planar. Although the single cover member 82 is used for both the first and second head holders 51A and 51B in the example illustrated in FIG. 6, alternatively, each of the first and second head holders 51A and 51B may have a separate cover member.

A pressing assembly 182 that contacts the head holders 51 from above is provided to the leading edge of the cover member 82. The pressing assembly 182 is constructed of pressing portions 182*a*, 182*b*, and 182*c* as illustrated in FIG. 6. An elastic member 83 such as a coil spring is provided between the cover member 82 and the carriage 5, so that the pressing assembly 182 of the cover member 82 presses the head holders 51 in a direction indicated by arrow C in FIG. 5 using a tensile force of the elastic member 83.

As a result, the head holders 51 are rotated about the reference shaft 71 in a clockwise direction indicated by arrow C in FIG. 5 by the cover member 82, and are pressed against the reference shaft 71 and toward the carriage 5, thereby setting the orientation of each of the head holders 51. In other words, the pressing portions 182*a*, 182*b*, and 182*c* of the pressing assembly 182 press the head holders 51, which are hooked on the reference shaft 71, simply by closing the cover member 82 to cover the head holders 51, so that the orientation of each of the head holders 51 is accurately set, thereby facilitating accurate positioning of the recording heads 6 mounted on the head holders 51 and allowing easy replacement of the recording heads 6.

The configuration of the carriage 5 is described in greater detail below, with reference to FIGS. 7 through 12.

Figure 7:
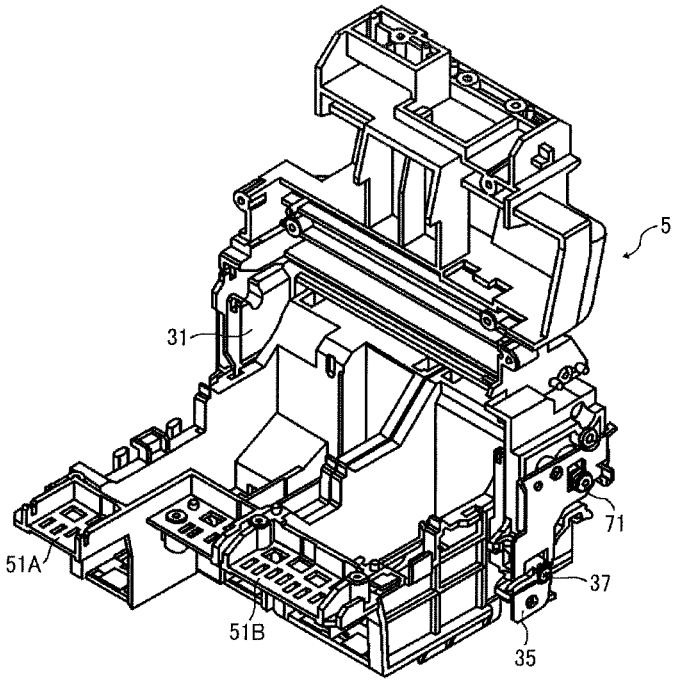
FIG. 7 is a perspective view of the carriage included in the image forming apparatus according to the first illustrative embodiment.
Figure 8:
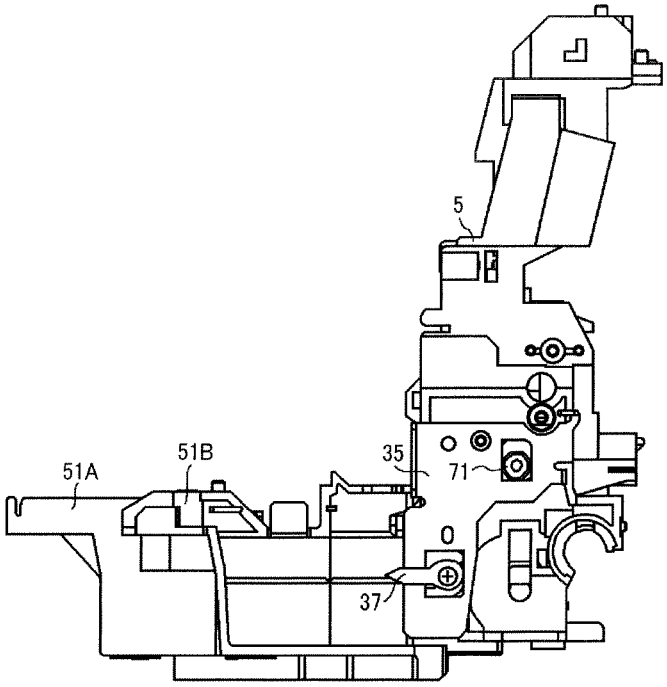
FIG. 8 is a side view of the carriage.
Figure 9:
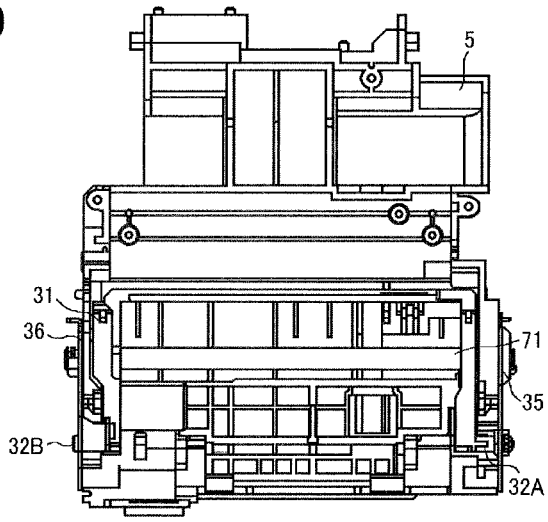
FIG. 9 is a front view of the carriage.
Figure 10:
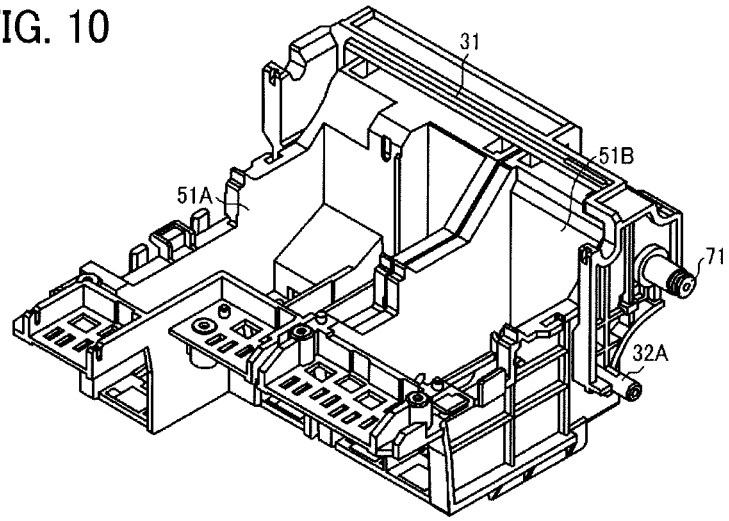
FIG. 10 is a perspective view of the head holders and an intermediate holder included in the image forming apparatus.
Figure 11:
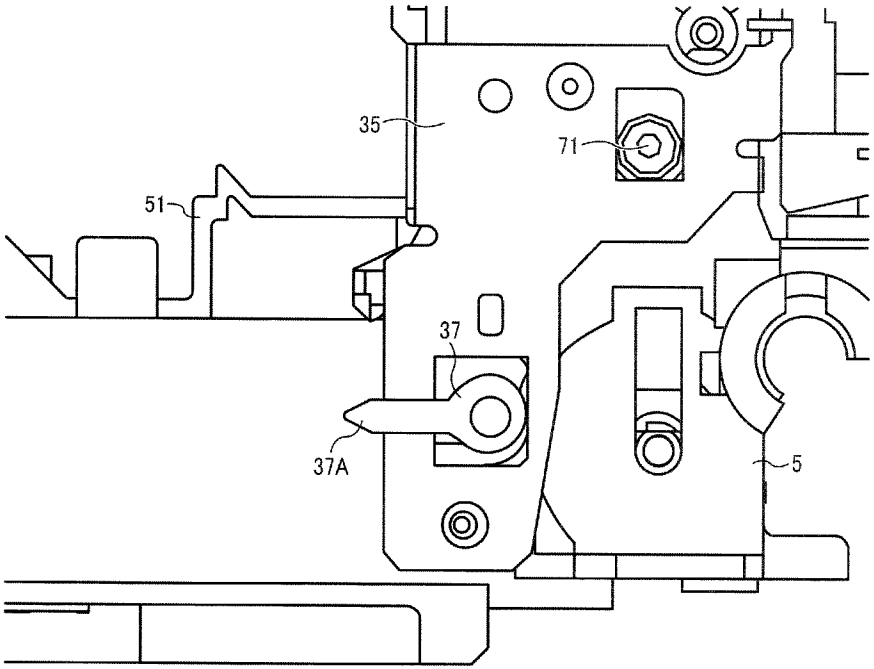
FIG. 11 is a schematic view illustrating an example of a configuration of an adjustment cam included in the image forming apparatus.
Figure 12:
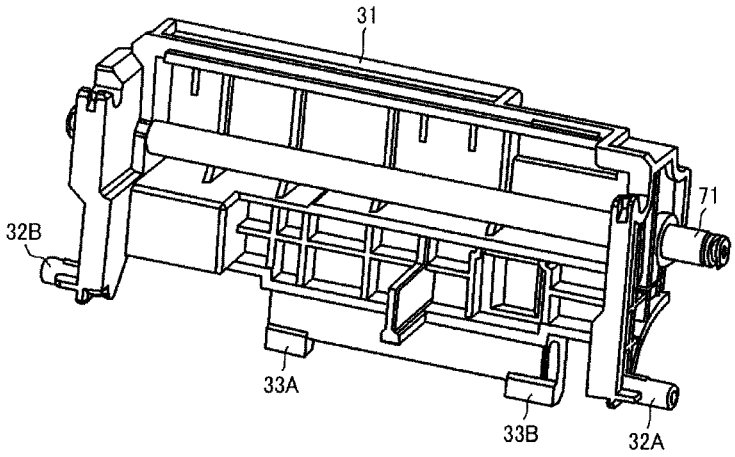
FIG. 12 is a perspective view of the intermediate holder.

FIG. 7 is a perspective view of the carriage 5 included in the image forming apparatus 1 according to the first illustrative embodiment. FIG. 8 is a side view of the carriage 5. FIG. 9 is a front view of the carriage 5. FIG. 10 is a perspective view of the head holders 51 and the intermediate holder 31. FIG. 11 is a schematic view illustrating an example of a configuration of an adjustment cam 37 included in the image forming apparatus 1. FIG. 12 is a perspective view of the intermediate holder 31.

The intermediate holder 31 is provided between the carriage 5 and the head holders 51. For example, the intermediate holder 31 is hooked on the reference shaft 71 to be held by the carriage 5, and right and left sub-reference portions 32A and 32B of the intermediate holder 31 are supported by right and left adjustment plates 35 and 36 provided to both lateral faces of the carriage 5, respectively. The intermediate holder 31 has substantially the same width as the carriage 5 in an axial direction of the reference shaft 71. The orientation of the intermediate holder 31 relative to the carriage 5 is restricted by the reference shaft 71 and the right and left sub-reference portions 32A and 32B respectively supported by the right and left adjustment plates 35 and 36.

The hooks 53 of the head holders 51 are hooked on the reference shaft 71, respectively, and the contact portions 58 of the head holders 51 contact against first and second contact parts 33A and 33B provided to the intermediate holder 31, respectively, so that the orientation of each of the head holders 51 is restricted.

While holding the head holders 51, the intermediate holder 31 is movable upward and downward by a cam to adjust a gap between a nozzle face of each of the recording heads 6, in which multiple nozzles are formed, and a recording medium such as the sheet 20. When the carriage 5 is located at a home position, the cam is coupled to a drive source, not shown, to transmit a drive force to the intermediate holder 31, so that the intermediate holder 31 is movable upward and downward.

Figure 13:
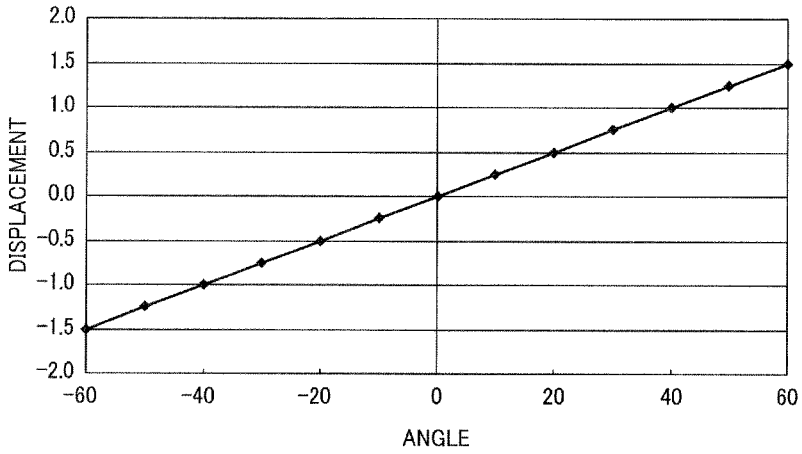
FIG. 13 is a graph showing a relation between an angle of an eccentric cam and an amount of displacement of the intermediate holder.
Figure 14:
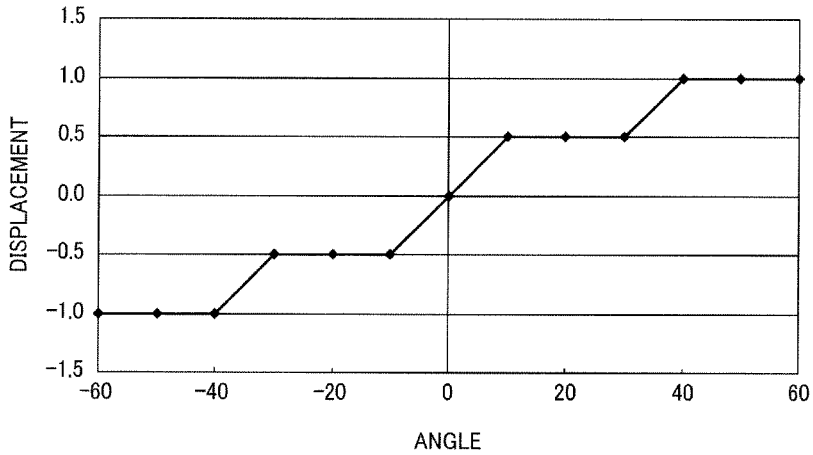
FIG. 14 is a graph showing a relation between an angle of a toothed cam and an amount of displacement of the intermediate holder.

The right and left sub-reference portions 32A and 32B are provided on both sides of the intermediate holder 31 in the axial direction of the reference shaft 71, respectively. The left sub-reference portion 32B provided on the left side of the intermediate holder 31 is fixed to the left adjustment plate 36. The right sub-reference portion 32A provided on the right side of the intermediate holder 31 is provided with an adjustment member, which, in the present illustrative embodiment, is an adjustment cam 37. The adjustment cam 37 is pressed against the right adjustment plate 35 in the sub-scanning direction, that is, rightward in FIG. 8, by a force in which the head holders 51 press the first and second contact portions 33A and 33B of the intermediate holder 31 in the sub-scanning direction. The adjustment cam 37 has a lever 37A. Relative positions of the right adjustment plate 35 and the right sub-reference portion 32A of the intermediate holder 31 are adjustable in the sub-scanning direction by rotating the lever 37A. To prevent easy displacement of the adjustment cam 37, the adjustment cam 37 engages the right sub-reference portion 32A relatively tightly, such that the adjustment cam 37 is immovable unless a relatively large force is applied to the lever 37A. It is to be noted that, optionally, multiple teeth may be formed in a face of the adjustment cam 37 to change the position of the adjustment cam 37 for each tooth. In a case in which an eccentric cam is used as the adjustment cam 37, an amount of displacement of the right sub-reference portion 32A in the sub-scanning direction is changed continuously, without stages, relative to the angle of the adjustment cans 37 as shown in FIG. 13. By contrast, in a case in which a toothed cam is used as the adjustment cam 37, the amount of displacement of the right sub-reference portion 32A in the sub-scanning direction is changed in stages relative to the angle of the adjustment cam 37 as shown in FIG. 14.

As described above, the intermediate holder 31 is rotatable about the reference shaft 71, and the left sub-reference portion 32B of the intermediate holder 31 is fixed to the left adjustment plate 36. The right sub-reference portion 32A of the intermediate holder 31 is movable by the adjustment cam 37 in the sub-scanning direction perpendicular to the axial direction of the reference shaft 71. As a result, the intermediate holder 31 is twisted in the lateral directions, so that the relative positions of the first contact part 33A of the intermediate holder 31 contacted by the first head holder 51A and the second contact part 33B of the intermediate holder 31 contacted by the second head holder 51B are adjustable.

At this time, the relative positions of the first and second head holders 51A and 51B within the intermediate holder 31 are set only by the relative positions of the reference shaft 71 and the first and second contact parts 33A and 33B of the intermediate holder 31, which are contacted by the contact portions 58 of the first and second head holders 51A and 51B, respectively. Therefore, the twist in the intermediate holder 31 does not twist each of the head holders 51 itself and the relative positions of the head holders 51.

In other words, even when the right sub-reference portion 32A of the intermediate holder 31 is displaced in the sub-scanning direction (i.e., leftward in FIG. 8) to twist the intermediate holder 31, the reference shaft 71, which is a main reference portion for the first and second head holders 51A and 51B, remains stationary, and only the second contact part 33B of the intermediate holder 31 is moved forward in FIG. 12 (or leftward in FIG. 8) beyond the contact part 33A. Thus, the relative positions of the first and second head holders 51A and 51B are changed substantially only in the sub-scanning direction, so that the second head holder 51B is offset leftward in FIG. 8 from the first head holder 51A, without a twist in each of the head holders 51A and 51B. In a case in which the intermediate holder 31 is not provided, the change in the relative positions of the head holders 51 is not limited to the sub-scanning direction, and thus the relative positions of the head holders 51 are twisted even when the adjustment cam 37 is provided, thereby degrading image quality.

As described above, the change in the relative positions of the first and second contact parts 33A and 33B of the intermediate holder 31 changes the relative positions of the first and second head holders 51A and 51B in the sub-scanning direction. As a result, the landing positions of the black ink droplets ejected from the recording heads 6A and 6B installed in the first head holder 51A and the landing positions of the color ink droplets ejected from the recording heads 6C, 6D, and 6E installed in the second head holder 51B are adjusted in the sub-scanning direction even after the first and second head holders 51A and 51B are mounted on the carriage 5.

Figure 15:
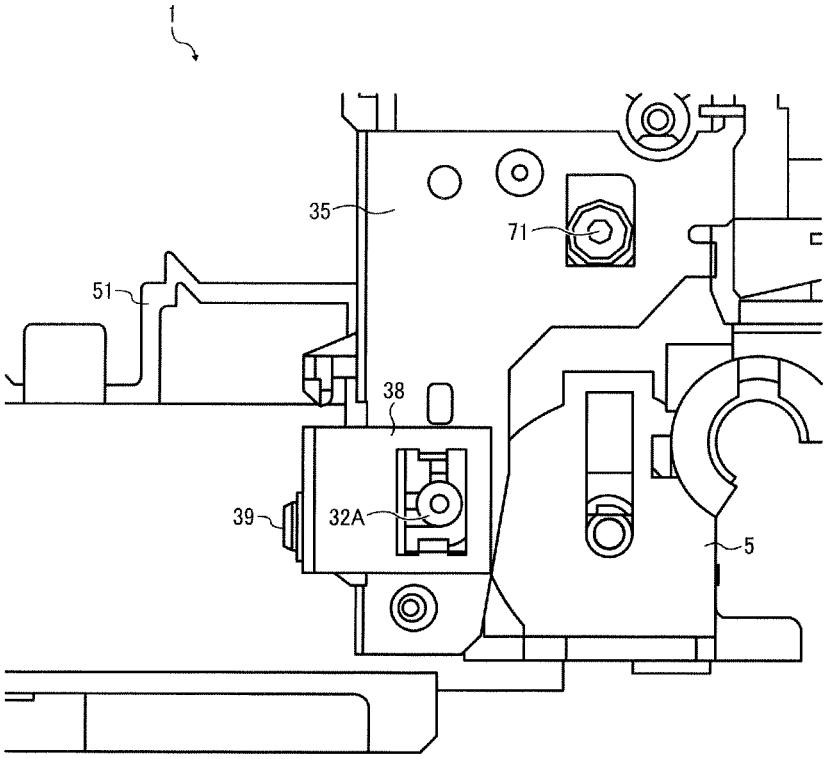
FIG. 15 is a schematic view illustrating an example of a configuration of a feed screw mechanism included in an image forming apparatus according to a second illustrative embodiment.

A description is now given of the image forming apparatus 1 according to a second illustrative embodiment, with reference to FIG. 15.

FIG. 15 is a schematic view illustrating an example of a configuration of a feed screw mechanism 39 included in the image forming apparatus 1 according to the second illustrative embodiment.

In the second illustrative embodiment, an adjustment plate 38 and the feed screw mechanism 39 are used as the adjustment member, in place of the adjustment cam 37 according to the first illustrative embodiment. The right sub-reference portion 32A of the intermediate holder 31 is fixed to the adjustment plate 38, and the adjustment plate 38 is moved in the lateral directions in FIG. 15 by the feed screw mechanism 39 to change the relative positions of the adjustment plate 38 and the right adjustment plate 35. Accordingly, the right sub-reference portion 32A of the intermediate holder 31 is displaceable relative to the right adjustment plate 35, and thus the same effects as those achieved by the adjustment cam 37 according to the first illustrative embodiment are achieved.

The provision of the adjustment member according to the foregoing illustrative embodiments facilitates adjustment of the landing positions of the black and color ink droplets in the sub-scanning direction upon replacement of the recording heads 6, even in the state in which the recording heads 6 are mounted on the carriage 5.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus, comprising:

a plurality of recording heads, from each of which droplets are ejectable;

a plurality of head holders to hold the plurality of recording heads;

a guide member extending in a main scanning direction;

a carriage movable in the main scanning direction along the guide member to hold the plurality of head holders;

a reference member provided to the carriage and extending in the main scanning direction, the reference member holding the plurality of head holders arranged side by side;

an intermediate holder disposed between the carriage and the plurality of head holders and supported by the carriage with the reference member as a main reference portion and at least two sub-reference portions provided thereto;

an adjustment member disposed to oppose at least one of the two sub-reference portions and to displace the at least one of the two sub-reference portions in a sub scan direction which is perpendicular to the main scanning direction, relative to the carriage; and contact portions provided to the plurality of respective head holders to contact the carriage in the sub scan direction, the plurality of head holders being movable, with the reference member as a main reference portion, to contact the intermediate holder and to be movable in the sub scan direction by the intermediate holder.

2. The image forming apparatus according to claim 1, wherein another one of the two sub-reference portions is fixed to the carriage.

3. The image forming apparatus according to claim 1, wherein the adjustment member displaces the one of the two sub-reference portions of the intermediate holder in stages.

4. The image forming apparatus according to claim 1, wherein the adjustment member displaces the one of the two sub-reference portions of the intermediate holder continuously without stages.

5. The image forming apparatus according to claim 1, wherein the adjustment member comprises a cam.

6. The image forming apparatus according to claim 1, wherein the adjustment member comprises a feed screw mechanism.

7. The image forming apparatus according to claim 1, wherein contacts parts are provided to the intermediate holder to contact the respective contact portions provided to the head holders, and one of the two sub-reference portions is moved in the sub scan direction by the adjustment member, and the other of the two sub-reference portions is fixed in position relative to the carriage in the sub scan direction, so that the intermediate holder is twisted in the sub scan direction and relative positions in the sub scan direction of the contact parts provided to the intermediate holder and contacted by the respective head holders are adjusted.

8. The image forming apparatus according to claim 1, further comprising:

a conveyance unit to convey a recording medium in a sheet conveyance direction to the recording head, wherein the sub scan direction in which the head holders is movable is the sheet conveyance direction.

* * * * *